US006416200B1

(12) United States Patent
George

(10) Patent No.: US 6,416,200 B1
(45) **Date of Patent: *Jul. 9, 2002**

(54) SURFACE LIGHTING SYSTEM

(75) Inventor: Ben George, Santa Ana, CA (US)

(73) Assignee: Permlight Products, Inc., Tustin, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/592,632

(22) Filed: Jun. 13, 2000

Related U.S. Application Data

(63) Continuation of application No. 09/154,255, filed on Sep. 16, 1998, now Pat. No. 6,082,870, which is a continuation of application No. 08/756,160, filed on Nov. 25, 1996, now Pat. No. 6,076,936.

(51) Int. Cl.[7] ..... F21S 4/00

(52) U.S. Cl. ..... 362/146; 362/240; 362/246; 362/249

(58) Field of Search ..... 362/145, 146, 362/147, 227, 235, 236, 240, 244, 246, 248, 249, 355, 800

(56) References Cited

U.S. PATENT DOCUMENTS

| | | | | |
|---|---|---|---|---|
| 3,500,036 | A | 3/1970 | Szentveri | 362/152 |
| 3,663,808 | A | 5/1972 | Baatz | 362/152 |
| 3,885,144 | A | 5/1975 | Lewis et al. | 362/31 |
| 4,143,411 | A | 3/1979 | Roberts | 362/145 |
| 4,271,458 | A | 6/1981 | George, Jr. | 362/236 |
| 4,337,759 | A | 7/1982 | Popovich et al. | 126/438 |
| 4,544,996 | A | 10/1985 | George | 362/238 |
| 4,600,975 | A | 7/1986 | Roberts | 362/147 |
| 4,612,606 | A | 9/1986 | Roberts | 362/146 |
| 4,625,266 | A | 11/1986 | Winter | 362/146 |
| 4,665,470 | A | 5/1987 | George, Jr. | 362/236 |
| 4,855,882 | A | 8/1989 | Boss | 362/238 |
| 4,907,361 | A | 3/1990 | Villard | 40/565 |
| 4,908,743 | A | 3/1990 | Miller | 362/238 |
| 4,943,900 | A | 7/1990 | Gartner | 362/227 |
| 4,945,675 | A | 8/1990 | Kendrick | 47/33 |
| D311,588 | S | 10/1990 | Nagano | D26/24 |

(List continued on next page.)

OTHER PUBLICATIONS

US 3,692,903, 09/1972, Robinson (withdrawn)

"Super Flux LEDs"—Hewlett Packard catalog—pp. 1–25, 1–26.

"Escort Lights"—Tivoli—Aisle Lighting Systems, Extrusion, Tivoli Replacement Lamp System, Lens Cover, Brochure.

*Primary Examiner*—Alan Cariaso
(74) *Attorney, Agent, or Firm*—Knobbe, Martens, Olson & Bear, LLP.

(57) ABSTRACT

A tread area and step edge illumination system is disclosed which comprises a base member configured for attachment to an exposed edge or surface of a step or stair. The base member has a downwardly projecting rearward wall and a forwardly and downwardly extending forward wall portion, a downwardly facing opening being defined between the rearward and forward walls. A light strip assembly having an elongate light strip with a number of longitudinally spaced-apart miniature lights, for example prefocused LED's, mounted to the strip. The light strip assembly is detachably mounted to the base member so that light from the miniature lights on the light strip is directed downwardly through the downwardly facing opening when the lights are lit, the light strip assembly being mounted to the base member so that the light strip assembly can be selectively adjusted through an angle of about 60° to enable selective adjustment of the direction of light from the light strip assembly. A diffuser lens may be detachably mounted to the base member so that the lens is in the path of light from the light strip assembly when the lights are lit.

3 Claims, 2 Drawing Sheets

U.S. PATENT DOCUMENTS

| | | | | |
|---|---|---|---|---|
| D312,135 | S | 11/1990 | Nagano | D26/2 |
| 5,045,981 | A | 9/1991 | Nagano | 362/219 |
| 5,103,382 | A | 4/1992 | Kondo et al. | 362/250 |
| 5,222,799 | A | 6/1993 | Sears et al. | 362/146 |
| 5,343,375 | A | 8/1994 | Gross et al. | 362/240 |
| 5,404,869 | A | 4/1995 | Parkyn, Jr. et al. | 126/699 |
| 5,430,627 | A | 7/1995 | Nagano | 362/146 |
| 5,499,170 | A | 3/1996 | Gagne | 362/84 |
| 5,594,628 | A | 1/1997 | Reuter et al. | 362/249 |
| 5,607,227 | A | 3/1997 | Yasumoto et al. | 362/249 |
| 6,082,870 | A * | 7/2000 | George | 362/146 |

* cited by examiner

SURFACE LIGHTING SYSTEM

This application is a continuation of U.S. application Ser. No. 09/154,255, filed Sep. 16, 1998, now U.S. Pat. No. 6,082,870, which is a continuation of U.S. Ser. No. 08/756,160, filed Nov. 25, 1996, now U.S. Pat. No. 6,076,936.

BACKGROUND OF THE INVENTION

1 Field of the Invention

The present invention relates generally to the field of apparatus or systems for lighting or illuminating steps or stairs, and more particularly to the field of apparatus or systems for illuminating the tread area and the edges of steps 2 Background Discussion It will be appreciated that there exists a necessity to light or illuminate the tread area and the edges of steps or stairs, especially in business establishments such as theaters and restaurants, where the steps or stairs may be in dark or dimly lighted areas.

Owners or operators of the business establishments that fail to provide adequate lighting at the edge of stairs or steps may be legally liable for substantial damages in the case of injury accidents to customers or patrons who misstep and fall because of losing their footing on dark or poorly lighted stairs or steps. If the business owners or operators were aware of a potentially dangerous lighting conditions for their stairs or steps, they may be subject to high punitive damages.

Homeowners may be equally liable to guests who fall as a result of unlit or poorly illuminated stairs, or steps in dark areas, such as in basements or attics.

It can further be appreciated that although edges of steps or stairs in dark areas, such as darkened theaters, need to be illuminated sufficiently to avoid trips and falls of patrons, the illumination needs to be such that it is unobtrusive. That is, the lighting needs to perform its function without being unduly distracting.

It is the principal objective of the present invention to provide an improved tread area and step edge lighting system which satisfies the foregoing requirements.

SUMMERY OF THE INVENTION

In accordance with the present invention, there is provided a tread area and step edge illumination system which comprises a base member configured for attachment to an upper exposed edge of a step or stair, or the like, the base member having a downwardly projecting rearward wall and a forwardly and downwardly extending forward wall portion, a downwardly facing opening being defined between the rearward and forward walls.

Included is a light strip assembly having an elongate light strip with a number of longitudinally spaced-apart miniature lights mounted to the strip, and means for detachably mounting the light strip assembly to the base member so that light from the miniature lights on the light strip is directed downwardly through the downward facing opening when the lights are lit. Preferably the lights are small, long-life pre-focused LED's.

In accordance with a preferred embodiment of the invention, the means for detachably mounting the light strip assembly in the base member enable angular adjustment of the light strip assembly through a preestablished angle, which is between 0° and about 60° so as to enable the selective direction of light from the light strip assembly through the preestablished angle.

The illuminating system preferably also includes a light diffusing lens and means for detachably mounting the lens to the base member so that the lens is in the path of emitted light from the light strip assembly when the lights are lit.

BRIEF DESCRIPTION OF THE DRAWINGS

The present invention can be more readily understood by a consideration of the following detailed description when taken in conjunction with the accompanying drawings, in which.

In the various FIGS., the same elements and features are given the same reference numbers.

DESCRIPTION OF THE PREFERRED EMBODIMENT

Figures 1, 2:
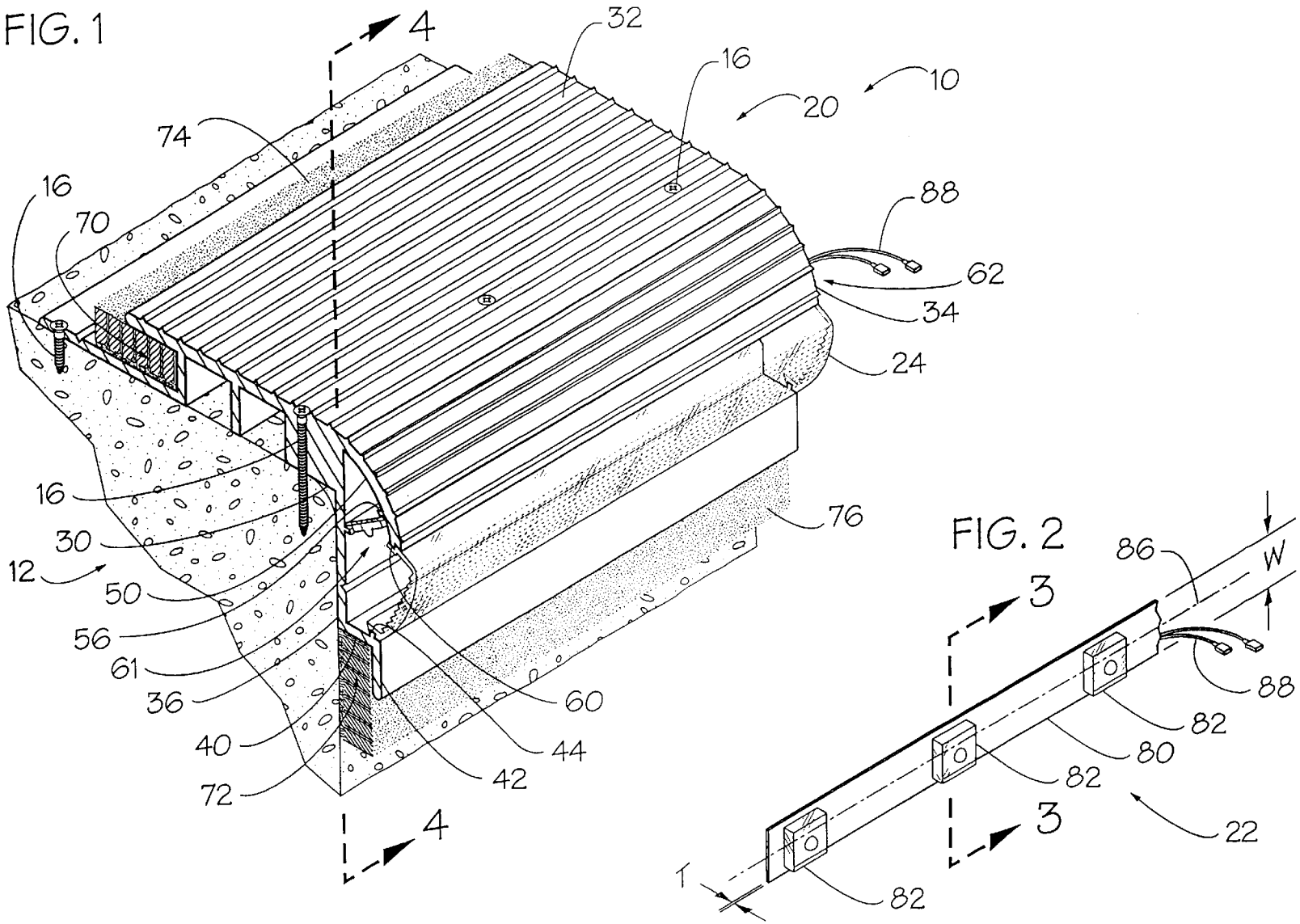
FIG. 1 is a perspective drawing of the step edge lighting system of the present invention showing a step edge base having installed therein an elongate lighting strip and an elongate lens, and showing the apparatus attached to a representative step edge.
FIG. 2 is a perspective drawing of the lighting strip of FIG. 1 showing the installation thereon of a plurality of longitudinally spaced apart lighting elements.

There is shown in FIG. 1 a step edge lighting apparatus or system 10 that is particularly adapted for lighting or illuminating the tread area of steps or stairs.

Step edge lighting system 10 is shown in FIG. 1 as being attached to an upper edge region 12 of a representative step or stair 14, for example by screws 16, for purposes of describing the invention. It will, however, be appreciated that step edge lighting system is not limited thereto, and can also be used to advantage to illuminate edge regions of such other objects or structures as platforms or patios, roof or rafter edges or exposed edges of decorative planters.

Figure 3:
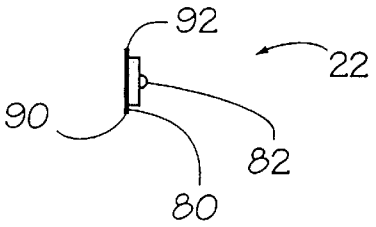
FIG. 3 is a transverse cross sectional drawing taken along line 3—3 of FIG. 2, showing one of the lighting elements.
Figure 4B:
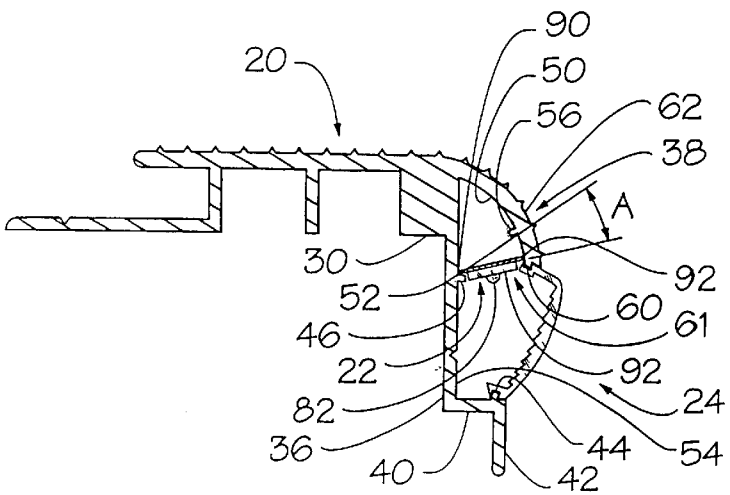
FIG. 4 is a transverse cross sectional drawing taken along line 4—4 of FIG. 1, FIG. 4A showing a first position of the lighting strip for providing a generally downwardly directed light and FIG. 4B showing a second position of the lighting strip for providing a light that is generally directed downwardly and forwardly.
Figure 5:
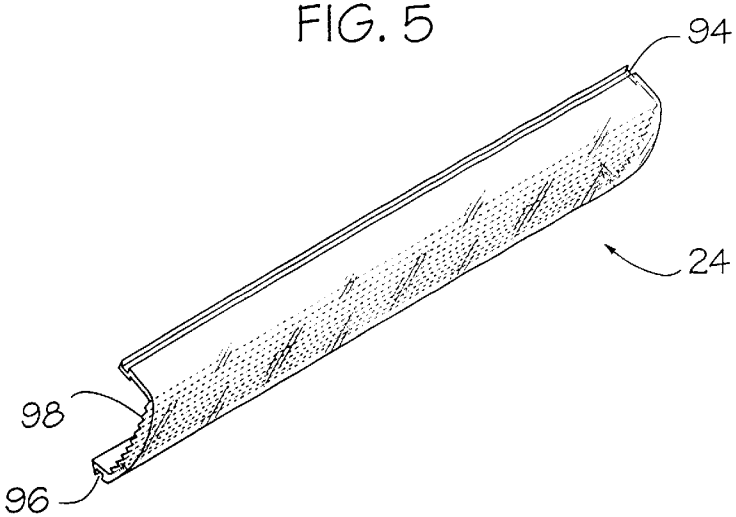
FIG. 5 is a perspective drawing of the lens showing its general construction.

Comprising generally step edge lighting system 10 are a base member or portion 20 (FIGS. 1 and 4), an elongate light strip assembly 22 (FIGS. 1–3) and an elongate lens 24 (FIGS. 1, 4 and 5).

Base portion 20 comprises an elongate structure formed having a 90 degree inner corner region 30 (FIG. 1) which enables the base portion to fit closely around upper forward step corner region 12.

Further forming base portion 20 are a flat upper surface portion 32 and a depending forward nose portion 34, the latter of which comprises a depending, rearward wall or leg 36 and a forwardly and downwardly arched front wall 38. Extending forwardly from the bottom of rearward leg 36 is a short flange 40 that has, at its free, forward end a short depending flange 42 and a shorter, upwardly projecting, longitudinally-extending lens-mounting rib 44 that is set slightly rearwardly of flange 42 (best seen in FIG. 4A).

A short, longitudinally-extending light strip retaining rib 46 projects forwardly from rearward leg 46 somewhat more than halfway up from the lower end of the leg. Forward wall 38 is constructed so that an inner surface 50 thereof is at a constant radius, R, from an upper intersection line 52 of rib 46 and lower regions of an inner surface 54 of rearward wall 36.

Figure 4A:
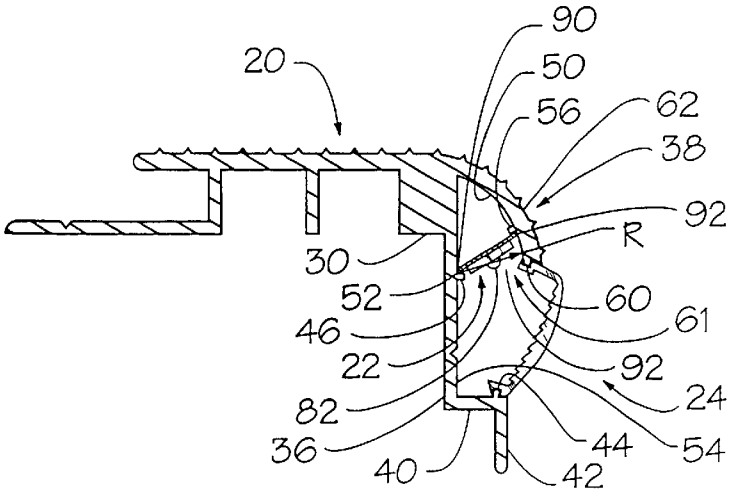

A short, longitudinally-extending light strip retaining rib 56 projects rearwardly from inner surface 50 of forward wall 38 near a lower, free end 60 thereof (FIGS. 4A and 4B). A downward facing opening 61 is defined between rearward wall 36 and forward wall 38 at lower end 60 thereof (FIG. 4A).

A forward surface 62 of forward wall 38 may, as shown in FIGS. 1 and 4A and 4B), be sculptured with plurality of ridges as shown or may be smooth.

Base portion 20, which may further provide recesses 70 and 72 for edge regions of carpets 74 and 76 (FIG. 1), is preferably, but not necessarily, extrusion molded of a strong plastic, such as urethane, PVC or styrene.

Light strip 22 comprises a thin, narrow strip 80 of heat resistant, electrically inert material such as micarta. The width, W, of strip 80 is substantially equal to above-mentioned radius, R. Strip 80 has a thickness, T, which may be about 1/32 of an inch.

Mounted through strip 80 are a number of longitudinally spaced-apart miniature lights 82. Lights 82, which may be spaced several inches apart along a centerline longitudinal axis 86 of strip 80, may advantageously comprise a "Superflux" pre-focused LED obtainable from Hewlett Packard. For example, a Hewlett Packard amber, type HPWA-DL00 having a 60° viewing angle and consuming about 147 mW may be used. Lights 82 are connected by electrical conduits 88 to a suitable power source (not shown).

Upon assembly of lighting system 10, light strip 22 is inserted in base portion 20 so that an inner edge 90 (FIGS. 3, 4A and 4B) is resting on top of rib 46 of rearward leg 36 and the other edge 92 of the strip is below rib 56 of forward portion 38. In such position, light strip can be pivoted about rib 46 through an angle "A" which is about 60° (FIG. 4B), as may be desired to provide the desired angle of illumination through opening 61.

Lens 24 is constructed from a rigid transparent or translucent plastic for being detachably attached between rib 44 at lower regions of rearward portion 36 and lower end 60 of forward wall 38. Lens. 24 is formed having a small, longitudinal upper recess 94 and a corresponding lower recess 96 (FIG. 5) to enable such detachable attachment to base portion 20. As shown in FIG. 5, lens 24 may be formed having a longitudinally grooved inner surface 98 to provide diffusion of light from lights 82. On the other hand, lens 24 may be eliminated for maximum illumination purposes.

Although there has been described and illustrated a step edge lighting apparatus in accordance with the present invention for purposes of illustrating the manner in which the invention may be used to advantage, it is to be appreciated that the invention is not limited thereto. Therefore, any and all variations and modifications that may occur to those skilled in the applicable art are to be considered as being within the scope and spirit of the claims as appended hereto.

What is claimed is:

1. An illumination apparatus for attachment to a substantially vertical surface, comprising:

a support member comprising a generally vertical wall having a rear side, a front side opposite said rear side, and a projection extending transversely from an upper portion of said front side of said wall and downwardly in spaced relation to said front side, said support member including a cavity between said front side and said projection, said cavity having an opening comprised of an edge portion of said projection;

a light source assembly mounted on the support member, said assembly having a series of miniature lights comprised of light emitting diodes (LEDs), said miniature lights being spaced apart from each other and electrically interconnected, said projection oriented such that light from said LEDs passes out of said cavity opening in a generally downward direction towards a substantially horizontal surface that is below said cavity opening and extends perpendicular to said vertical surface, said miniature lights being prefocused to focus light from said LEDs to confine the light to a predetermined angle, the prefocused LEDs providing respective light beams which, when combined, illuminate said horizontal surface that extends perpendicularly from said vertical surface, said light source assembly mounted on said support member such that all of said miniature lights are disposed substantially at or above said edge portion of said cavity opening, whereby the miniature lights are substantially hidden from direct view when said apparatus is viewed in the direction of the front side.

2. The illumination apparatus of claim 1, further comprising a diffuser extending across said opening.

3. The illumination apparatus of claim 1, wherein the projection has an arcuate cross-sectional shape.

* * * * *